US008813767B2

(12) United States Patent
Parker et al.

(10) Patent No.: US 8,813,767 B2
(45) Date of Patent: Aug. 26, 2014

(54) PAINT ROLLER CLEANER

(75) Inventors: Linda Parker, Indianapolis, IN (US); Jason Ebert, Indianapolis, IN (US)

(73) Assignee: Designers With Vision LLC, Indianapolis ( * ) Notice: Subject to any disclaimer, the term of this patent is extended or adjusted under 35 U.S.C. 154(b) by 736 days.

(21) Appl. No.: 12/896,127

(22) Filed: Oct. 1, 2010

(65) Prior Publication Data

US 2012/0080062 A1 Apr. 5, 2012

(51) Int. Cl.
*B08B 3/00* (2006.01)

(52) U.S. Cl.
USPC ..... 134/198

(58) Field of Classification Search
CPC ..... B08B 3/02
See application file for complete search history.

(56) References Cited

U.S. PATENT DOCUMENTS 3,688,785 A * 9/1972 Stevens et al. ..... 134/138
3,934,614 A * 1/1976 Elek et al. ..... 138/44
4,324,018 A 4/1982 Olsson
4,995,749 A 2/1991 Gornik
5,409,027 A * 4/1995 Glunt ..... 134/138
5,452,734 A 9/1995 Steeves
5,515,567 A 5/1996 Washburn
5,539,948 A 7/1996 McCauley et al.
5,626,158 A 5/1997 Gratopp
6,125,497 A 10/2000 Galbreath
6,280,531 B1 8/2001 Galbreath
6,298,517 B1 10/2001 McKay
6,405,403 B1 6/2002 McKay
6,530,109 B1 3/2003 Cassedy

* cited by examiner

*Primary Examiner* — Jason Ko
(74) *Attorney, Agent, or Firm* — Woodard, Emhardt, Moriarty, McNett & Henry LLP

(57) ABSTRACT

Among other things, there is shown a device for cleaning or rinsing one or more paint roller covers simultaneously. In certain embodiments, a container is provided with one or more spindles within for accommodating the covers. Hubs to support or to rotate the covers may be on the spindles. A top closes the container and has a conduit connected to it, so that the conduit will be placed adjacent to the spindles when the container is closed. The conduit has a series of holes and/or slots to spray fluid toward covers on the spindles, making the covers spin around the spindles. Connections for fluid flow, for example from a consumer hose, are included to allow water or other fluid to flow into the conduit.

19 Claims, 6 Drawing Sheets

PAINT ROLLER CLEANER

BACKGROUND

In painting interior walls or other relatively large surfaces, rollers are well known devices for quickly and thoroughly applying the paint. Rollers generally have a handle for holding by the painter, to which is attached a rotatable arm. A soft cylindrical cover is placed over the arm, and the cover is dipped into a tray or other source of paint. The paint adheres to the cover, much as it does the various types of brushes used for painting. With the cover against the surface to be painted, the painter moves the roller generally linearly as he or she desires. As the handle is moved linearly, the cover rotates around the arm, applying paint to the surface.

When the painter is finished using the roller (e.g. when the task is completed, the supply of paint runs out, or the color is to be changed), the painter has two options. He or she may remove the cover from the roller and simply throw it away, or he or she may clean the roller in an appropriate rinse medium or solvent. Using water-base paint as an example, the painter may remove the roller, place it in a water bath or under a spigot, and squeeze or rub the cover to reduce the amount of paint in the soft material of the cover. However, these methods of cleaning a roller are tedious for an individual to perform, and they require a substantial amount of time to ensure that most of the paint is rinsed or washed off. Even when the cleaner takes that amount of time and effort to clean a cover, the amount of paint that remains is frequently enough to render the cover stiff or sticky following clean-up. Such remaining paint can also keep the painter from using the cover again for a different color of paint. Of course, throwing away a roller cover after one usage is wasteful for the do-it-yourself painter, but is particularly wasteful for professional painters or contractors that move from job to job. Often such contractors paint several locations in one or several houses or buildings with the same or similar colors, yet have no efficient way to clean and reuse roller covers.

Accordingly, there remains a need for devices and methods that can efficiently clean a paint roller cover to a better degree than for manual clean-up.

SUMMARY

Among other things, there is disclosed apparatus and methods for cleaning or rinsing paint roller covers. In particular embodiments, such apparatus may include a container having a top that encloses an internal volume, with the top being removable to allow access to the internal volume. First and second spindles are fixed to the container within the internal volume, and a conduit connectable to a source of fluid extending into the internal volume between the spindles. The conduit defines an internal lumen, and has a first set of openings that communicate with the lumen and are directed generally toward but off-center with respect to the first spindle. A second set of openings that communicate with the lumen are directed generally toward but off-center with respect to the second spindle.

In some embodiments, where the source of fluid is a hose to supply water under pressure, when water flows into the conduit it sprays out of the first set of openings substantially in a single plane and out of the second set of openings substantially in a single plane. For example, the first set of openings can be diametrically opposed to the second set of openings, with the spray from the first set of openings and that from said second set of openings being substantially coplanar and oppositely directed. Particular embodiments include at least one partial obstruction lodged in the lumen of the conduit. One or more of the openings may be longitudinally-oriented slots with linearly sloping sides, so that the length of a respective slot at the outside of the conduit is greater than its length at the inside surface surrounding the lumen of the conduit. The container can include at least one view port adapted to allow a user to see conditions inside, and that view port may be in the removable top. Some embodiments include a collar fixed to the container in its internal volume, so that the conduit seats in the collar when the top encloses the internal volume, providing some stability for the conduit.

Embodiments are also described of a device for cleaning paint roller covers that includes a container having one or more side walls, a bottom surface, and a removable top connectable to the side wall(s), so that the container defines a closed internal volume. A drain is provided in a lower portion of the container. Within the container is a support that includes a base member fixed to the container and at least one spindle fixed to and extending from the base member through said internal volume. The spindle(s) are sized to allow a paint roller cover around them. A conduit extends through the internal volume from the removable top. The conduit has a longitudinal lumen, a plurality of longitudinally aligned holes communicating with the lumen, and a plurality of longitudinally-oriented slots, each slot being between a pair of holes. At least part of the slots communicates with the lumen. The conduit can include one or more partial obstructions in the lumen (e.g. a washer, perhaps inserted into said lumen with an interference fit), and fluid entering the can exit through the holes and slots. Where there are more than one such obstructions, they may be spaced from each other.

Such devices can include a collar into which a portion of the conduit fits when the removable top is connected to the wall(s) of the container. In particular embodiments, the holes and slots are oriented so that they are directed to the side of the spindle(s). Multiple spindles may be provided, with each extending from the base member through the container's internal volume and sized to allow a paint roller cover around it, and in some embodiments a first and second spindle are on opposite sides of the conduit. In such cases, holes and slots may be arranged into multiple groups, e.g. first and second groups on opposite sides of the conduit. Embodiments can include a connection for a hose in fluid communication with the conduit. A valve can be included, for example between the connection and the conduit, with the valve being outside of the container's internal volume when the top is connected to the wall(s). Embodiments can include hub(s) connected to the spindle(s) to support a paint roller cover. Such hubs are removable from the spindles and replaceable onto the spindles, and the hubs may be configured to fit snugly within a paint roller cover.

These and other embodiments provide better structure and methods for cleaning paint roller covers and similar items, providing economy in terms of ability to reuse covers for a longer period than is generally possible. Such devices are lightweight, easy to use and store and transport, and can easily be used in non-industrial applications.

DESCRIPTION OF THE ILLUSTRATED EMBODIMENTS

Figure 1:
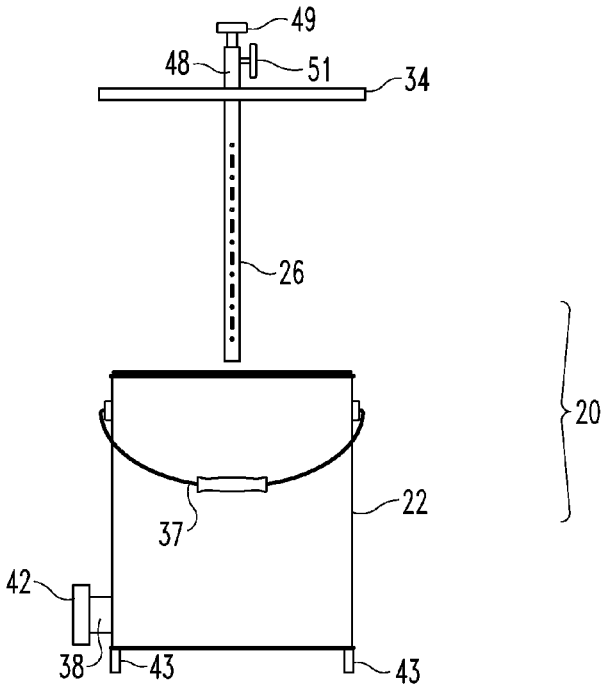
FIG. 1 is an exploded view of an embodiment of apparatus according to the present disclosure.
Figure 2:
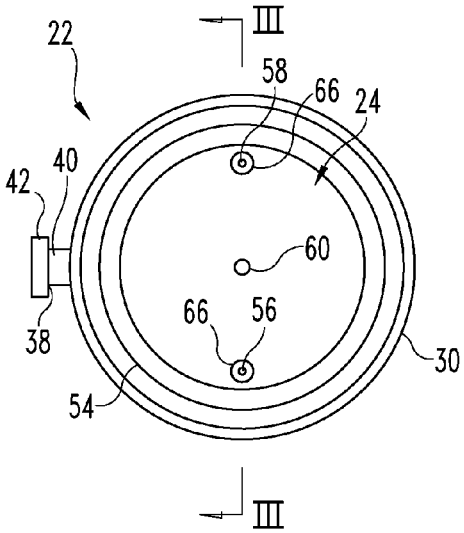
FIG. 2 is a top plan view of part of the embodiment of FIG. 1.
Figure 3:
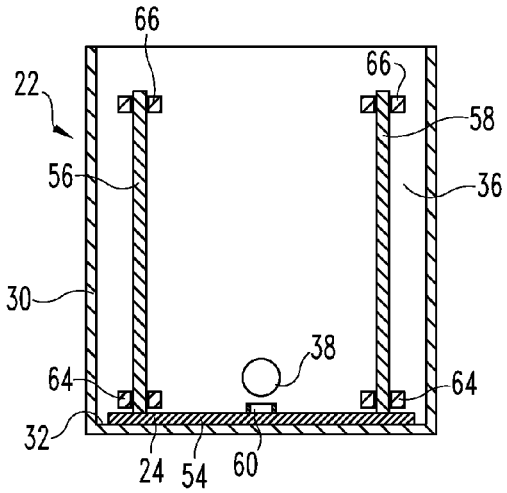
FIG. 3 is a cross-sectional view of the embodiment of FIG. 2, taken along the lines III-III in FIG. 2 and viewed in the direction of the arrows.
Figure 4:
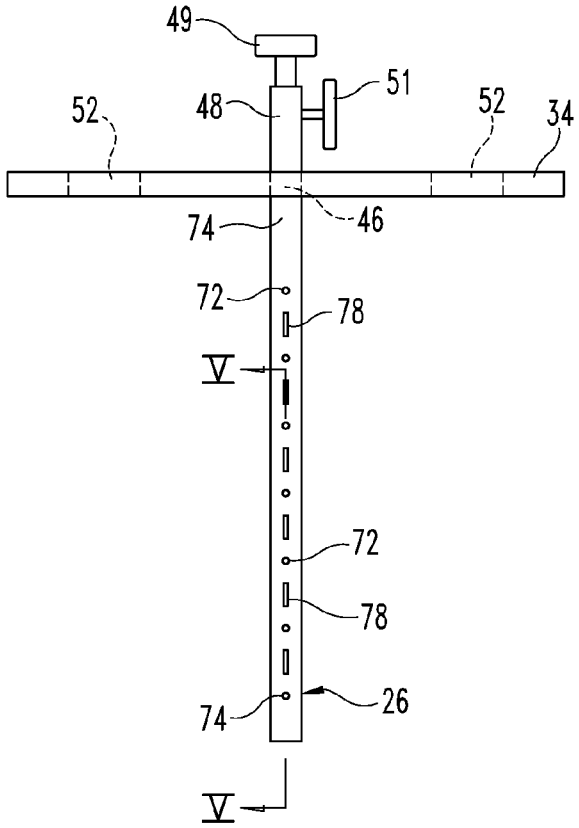
FIG. 4 is an elevational view of part of the embodiment of FIG. 1.

For the purposes of promoting an understanding of the principles of the disclosure, reference will now be made to the embodiments illustrated in the drawings and specific language will be used to describe the same. It will nevertheless be understood that no limitation of the scope of the claims is thereby intended, such alterations and further modifications in the illustrated embodiments, and such further applications of the principles of the disclosure as illustrated therein being contemplated as would normally occur to one skilled in the art to which the disclosure relates.

Referring now generally to the Figures, there are shown embodiments of a cleaning apparatus 20 for cleaning covers for paint rollers. The illustrated embodiment of apparatus 20 includes a container 22, a support 24, and a conduit 26. As will be further described below, support 24 is anchored to container 22 and conduit 26 is connected to support 24. Apparatus 20 is made for easy roller cover clean up at any of a number of locations, particularly at residences or commercial buildings that have common water faucet(s).

Container 22 is a lightweight, portable bucket-shaped device having an outer side wall 30, a bottom 32 monolithic with or fixed to wall 30, and a removable lid or top 34. In a particular embodiment, container 22 of apparatus 20 is a bucket of five, six or seven-gallon capacity in particular embodiments, so that nine-, thirteen- and/or eighteen-inch roller covers can be accommodated and cleaned in apparatus 20. The illustrated embodiment shows wall 30 as cylindrical and particularly circular which is believed to make manufacture easier and to minimize splatter as device 20 is used. It will be understood that other shapes of wall 30 can be used, such as rectangular, although a generally circular, oval or other rounded configuration may be preferable in terms of circulation of rinsing fluid and for better drainage and limiting of residue after use of apparatus 20. Wall 30 and bottom 32 define an internal volume 36. A handle 37 may be provided to enable the user to carry apparatus 20 between uses, or to hold apparatus 20 during emptying or cleaning, for example.

A drain 38 is provided in container 22. In the illustrated embodiment, drain 38 is a tube through a hole in wall 30 adjacent to bottom 32, having an external thread 40 to which an internally-threaded cap 42 can be attached to close drain 38. For example, drain 38 of container 22 is a 2½ inch or 3 inch PVC water outlet, threaded with cap 40, and bolted to container 22 with a seal between drain 38 and container 22 to minimize or prevent leakage. Drain 38 is placed slightly above bottom 32 in the embodiment so that apparatus 20 can sit evenly and without wobbling on the ground, a table, or other flat surface. It will be understood that other configurations of drain 38 can be used, such as a hole in wall 30 or bottom 32 into which a pliable plug (not shown) can be inserted. If drain 38 (in hole, tube or other configuration) is in bottom 32 of container 22, legs 43 may be provided (e.g. FIG. 1) as a part of container 22 (integrally or monolithically) or as a part of a separate support member to lift bottom 32 and drain 38 from the ground, floor or other surface and allow unobstructed flow through drain 38. Such a bottom drain can allow direct downward drainage to another container or subsequent drainage way. The arrangement of drain 38 and/or support 24 (as detailed below) preferably allows roller cover(s) being rinsed or cleaned to remain above the level of water that may collect on bottom 32 of container 22 prior to draining. If desired, a drain conduit and clamp (e.g. five-foot hose and three-inch hose clamp, not shown) may be provided to attach to drain 38 to ensure drainage away from the area where apparatus 20 is being used.

Top 34 fits snugly on wall 30 so as to cover or seal internal volume 36. Top 34 includes an opening 46, and in a particular embodiment a threaded connector connects conduit 26 with fitting 48. In other embodiments, conduit 26 may extend through opening 46 with a seal to maintain water-tightness. Fitting 48 in a particular embodiment is a straight fitting connecting conduit 26 to a connection 49 for attaching a source of rinsing medium, solvent or other fluid. In a particular embodiment, connection 49 is a standard female threaded brass swivel connection of a size and configuration to engage a hose 50 (e.g. a garden or similar hose connectable to a consumer or home spigot or faucet). Other embodiments of fitting 48 and/or connection 49 may be provided for connection to larger or smaller hoses or other conduits, or for other fluid sources, e.g. pumps. A valve 51 is provided in this embodiment in addition to or as part of fitting 48 for regulating fluid entering or passing through conduit 26. In some embodiments, top 34 can include one or more viewing ports 52, which are open apertures in the illustrated embodiment, but may also be covered or filled with transparent plastic, glass or other material. In a particular embodiment, top 34, conduit 26, valve 51, and fitting 49 are connected together into a movable unit. Conduit 26 may be connected to a ½ inch threaded connector through top 34 and glued to the connector with plumbers glue. The ½ inch connector is used to connect conduit 26 and valve 51. Fitting 49 in a particular embodiment is a brass swivel hose connector fitting for connection to a standard ¾ inch hose connection. Inside the swivel may be a rubber washer with a ½ inch hole, rather than the standard washer commonly provided with such swivels, to release more water pressure.

Support 24 in the illustrated embodiment includes a base plate or member 54 fixed to bottom 32 of container 22. This embodiment of base plate 54 is a relatively thin but sturdy planar member fixed directly to bottom 32 and is circular so as to match the shape of bottom 32, for ease of assembly and for beneficial movement or flow of fluid within container 22. It will be understood that some or all of support 24 could be elevated from bottom 24 in other embodiments. Spindles 56, 58 extend from a top surface of base member 54 away from bottom 32. Base member 54 is centered with respect to bottom 32 in this embodiment, with the center of base member 54 substantially at or over the center of bottom 32. Base member 54 includes a collar or fitting 60 into which conduit 26 fits, to stabilize and/or close the end of conduit 26. Collar or fitting 60 is substantially at or above the center of base member 54 (and centered in container 22) in this embodiment. Collar 60 may have a threaded fit with the end of conduit 26, in which case collar 60 may be rotatable with respect to base member 54 for connection with conduit 26, or collar 60 may have an interference, compression, sealed or other secure fit with conduit 26. Such a stable fit between conduit 26 and collar 60 or base member 54 helps keep conduit 26 stationary or in place with respect to base member 54 (and container 22) during use. For example, support 24 may be a manufactured piece of steel of approximately ⅛th inch in thickness and nine inches in circumference, and spindles 56, 58 may be rods thirteen inches in length and ½ inch in diameter. Support 24 with spindles 56, 58 is attached to the bottom 32 of container 22 with five ½ inch galvanized screws and bolts in a particular embodiment. In the center of support 24, collar 60 is provided to hold and back water into conduit 26, and in one embodiment collar 60 is a ½ inch end cap with one or more washers, and the cap is attached by a bolt and/or a screw to support 24.

Spindles 56, 58 are substantially identical and at least approximately equidistant from the center of base member 54 (and container 22) in the illustrated embodiment, and so for the sake of brevity and clarity they will be described with reference to spindle 56. Spindle 56 is a rigid axle fixed directly to base member 54 in this embodiment, at a distance from the center of container 22 greater than the radius of a roller cover plus the radius of conduit 26. A hub or spacer 64 is freely rotatable with respect to spindle 56, with hub 64 being connected to spindle 56 at or near base member 54. Accordingly, spindle 56 is positioned so that hub 64 and/or a roller cover can spin freely about spindle 56 without contacting conduit 26. In some embodiments, spindle 56 is about halfway between wall 30 and the center of container 22. Spindle 56 has a diameter smaller than the inner diameter of a paint roller cover, and hub 64 has a diameter larger than that of spindle 62. In one example, spindle 56 is a one-quarter inch diameter steel or other metal rod, and hub 64 has an outer diameter approximately the same as the inner diameter of a paint roller cover, so that such a cover fits snugly on hub 64. For situations in which a roller cover is smaller in inner diameter than the outer diameter of hub 64, the roller cover may simply sit on hub 64. In other embodiments, a roller cover can be attached directly to spindle 62, e.g. spindle 62 may have a diameter approximately the same as the inner diameter of a paint roller cover and be rotatably connected to base member 54. In embodiments in which hub 64 lies against base 54, hub 64 and base 54 may be made of materials that have reduced friction so that rotation of hub 64 (as noted below) is not significantly impeded. One or more journals or bearings (not shown) may also be placed between hub 64 and base member 54, between spindle 56 and base member 54, and/or between hub 64 and spindle 56 to reduce friction or permit rotation. In embodiments without hub 64, a bearing, washer or other spacer may be placed around spindle 56 to keep a roller cover above base member 54, even if such bearing, washer or spacer does not rotate around spindle 56.

An additional cap or hub 66 may be provided for the top of spindle 56. Hub 66 may be slidable on and off spindle 56 for ease of placing a roller cover over spindle 56 and fitting hub 66 within the roller cover. Like hub 64, hub 66 is easily rotatable with respect to spindle 56. It will be understood that hub 66 may be of a size that permits the roller cover to be placed over it and spindle 56, without temporarily removing hub 66. Use of hub 66 to hold the cover and support rotation around spindle 56 at both ends may not be necessary in all embodiments, but has been found to provide good results, with smooth rotation and oscillation minimized during cleaning of the cover. One or more sizes of hub 66 may be provided so as to have a hub 66 that fits particular sizes of roller covers.

Hubs 64 and/or 66 of apparatus 20 may be ½ inch diameter end caps, which help to stabilize the roller cover(s) on spindles 56, 58 and allow the roller cover(s) to spin consistently and at about the same rate compared to each other. The roller cover (e.g. roller cover 90) can be set atop a spacer and/or washer (on support 24) to keep the roller cover out of any standing water. Conduit 26 in the illustrated embodiment is a straight section of sturdy pipe. Conduit 26 extends through top 34 to fitting 48, with a seal around and/or movable with respect to top 34, and fits into collar 60 of base 54. In a particular embodiment, conduit 26 is fixed to fitting 48, e.g. by threading or other method of joining. When top 34 secured to the rest of container 22, conduit 26 is firmly held in this embodiment between collar 60 and top 34 against rotation or other motion, substantially along the central axis of container 22. As noted above, conduit 26 may be threaded with collar 60, or may have an interference or other close or secure fit with collar 60. Conduit 26 has an outer surface 67 and defines a central lumen 68 bounded by interior surface 69, with lumen 68 and surface 69 being substantially cylindrical in the illustrated embodiment. Lumen 68 is open at an upper end of conduit 26 for connection to fluid flow via fitting 48, valve 51 and/or connection 49, as indicated above. A lower end of lumen 68 is blocked by insertion into collar 60 in this embodiment, and in other embodiments may itself be capped or otherwise closed.

Conduit 26 includes two series of holes 70, 72. In the illustrated embodiment, holes 70, 72 are in respective lines longitudinally through one side of conduit 26, and diametrically opposed to each other. That is, holes 70 are arranged on one side of conduit 26 so that a line can be drawn through holes 70 that is parallel to the longitudinal axis of conduit 26, and holes 72 are similarly arranged on the diametrically-opposite portion of conduit 26. In a particular embodiment, holes 70 are substantially identical to each other and to holes 72, and are of a constant diameter of about one-eighth inch. The illustrated embodiment of conduit 26 includes end sections 74 that are free of holes 70, 72. In particular embodiments, the length of conduit 26 having holes 70, 72 is substantially the same as or greater than the length of a paint roller cover, so that when cover(s) are positioned on spindles 56, 58 (e.g. with hubs 64 holding them rotatably on spindles 56, 58), the holes 70, 72 face substantially the whole length of the cover(s).

Figure 5:
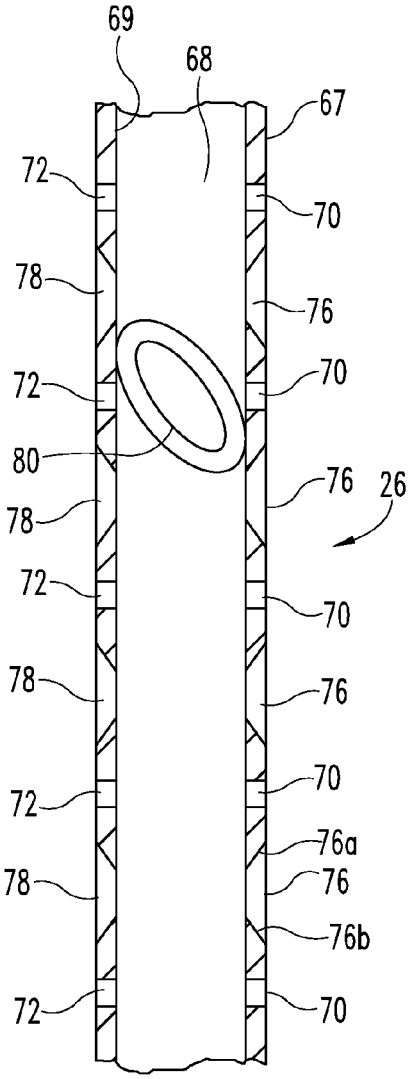
FIG. 5 is a cross-sectional view of part of the embodiment of FIG. 4, taken along the lines V-V in FIG. 2 and viewed in the direction of the arrows.
Figure 6:
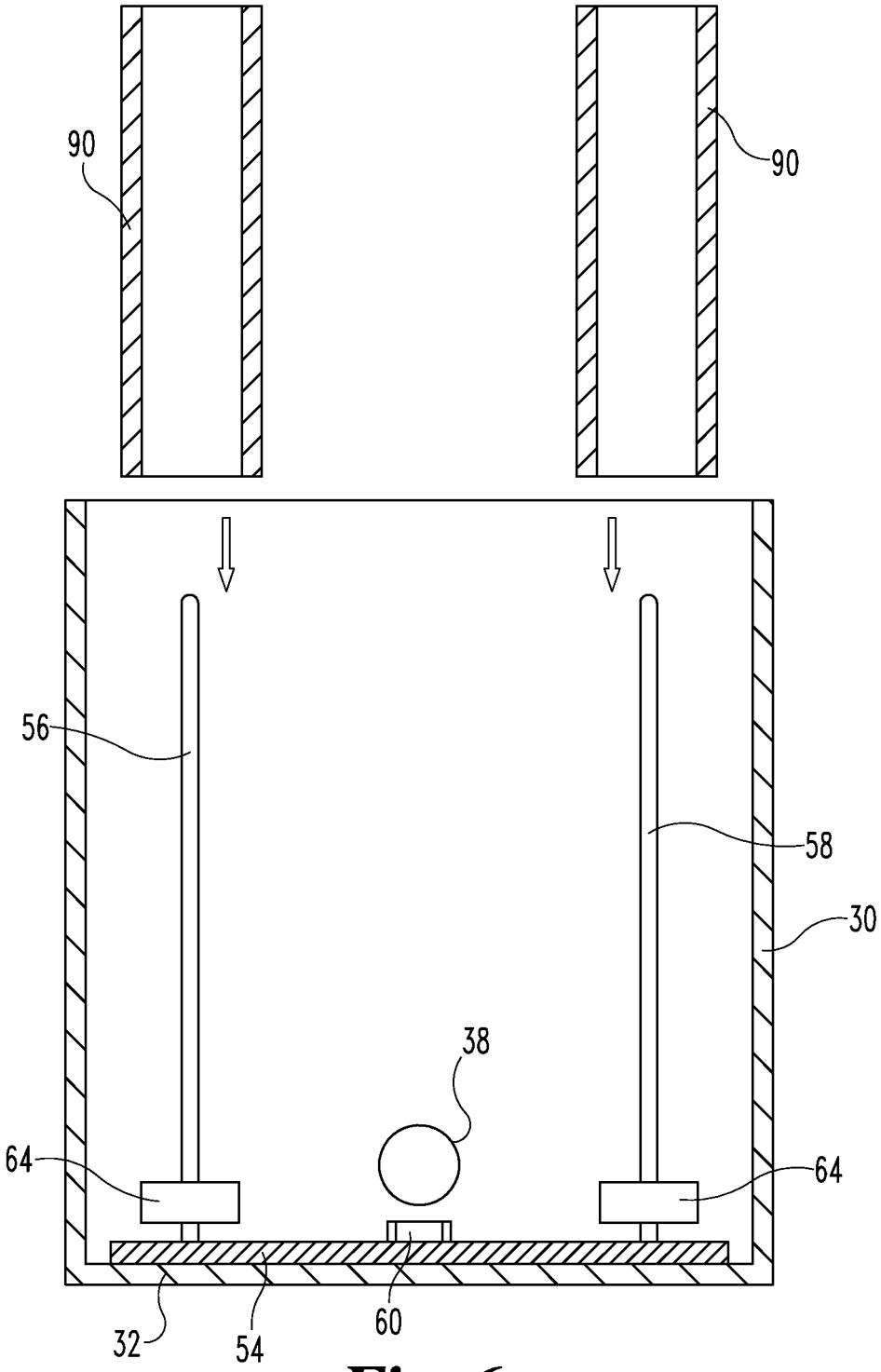
FIG. 6 is a part cross-sectional view of part of the embodiment of FIG. 1 indicating a manner of use.
Figure 7:
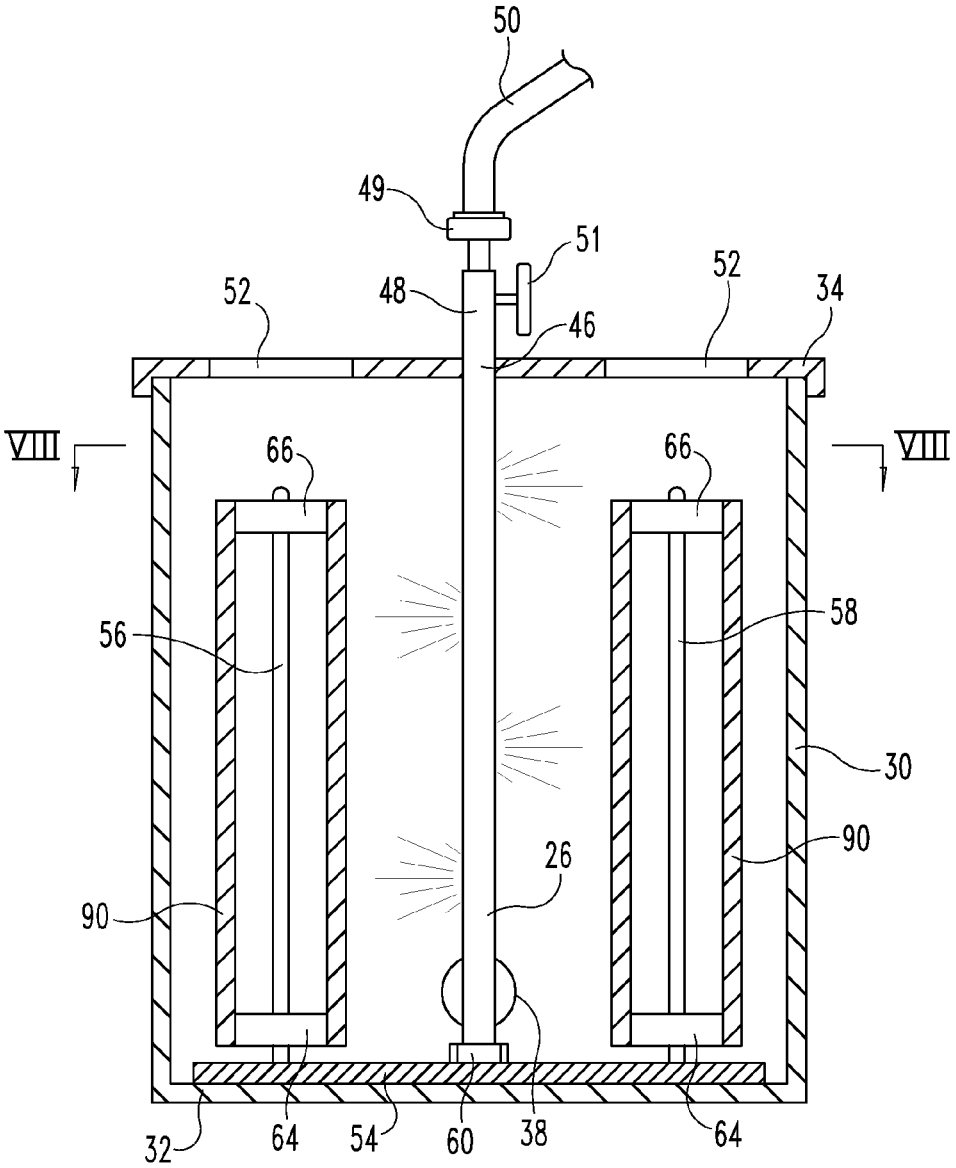
FIG. 7 is a part cross-sectional view of the embodiment of FIG. 1 indicating a manner of use.

Extending between adjacent holes 70 are respective slots 76, and between adjacent holes 72 are respective slots 78. In the illustrated embodiment, the inner surface 69 of conduit 26 is pierced by the entire diameter of holes 70, 72, and slots 76, 78 are shorter at inner surface 69 of conduit 26 than they are at outer surface 67. Slots 76, 78 vary in depth along their length, with their deepest being at their middles where they extend all the way through the wall of conduit 26, and their depth decreases as they extend from their middles. The illustrated embodiment shows slots 76 being substantially identical to each other and to each of slots 78 in configuration, and in a particular example slots 76 and 78 are about one-eighth inch wide. As seen in FIG. 5, for example, surfaces **76*a* and 76*b* of slot 76 each slope linearly between inner surface 69 and outer surface 67 of conduit 26**.

Figure 8:
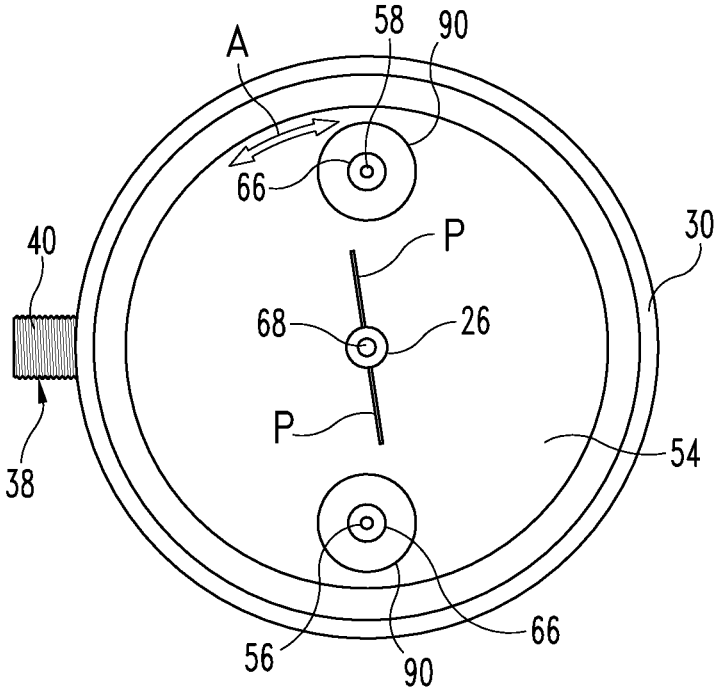
FIG. 8 is a cross-sectional view of the embodiment of FIG. 7, taken along the lines VIII-VIII in FIG. 7 and viewed in the direction of the arrows.

Holes 70, 72 and slots 76, 78 are oriented so that they are not pointed at the centers (or central longitudinal axes) of spindles 56, 58, but are pointed at least slightly away from those centers or axes. As one example, conduit 26 may be positioned with respect to spindles 56, 58 so that holes 70, 72 and slots 76, 78 are directed within an angle or arc that subtends the space around spindles 56, 58 in which a roller cover will be positioned (e.g. angle A in FIG. 8). As another example, holes 70, 72 and/or slots 76, 78 may be cut or formed in conduit 26 so that they are not radial, that is, they are angled away from the center of conduit 26. In some embodiments, holes 70, 72 and slots 76, 78 face a point about halfway between the center of spindles 56, 58 and the outermost extent of a roller cover, when the roller cover is connected to a spindle 56, 58.

Within lumen 68 of conduit 26 are one or more obstructions 80 that partially block lumen 68. An obstruction 80 in a particular embodiment is a flexible disc or washer (e.g. size 00 facet washer) having an outer diameter greater than the inner diameter of lumen 68. In embodiments in which a single obstruction 80 is used, it may be lodged (e.g. with an interference or other secure fit) approximately halfway along lumen 68. In other embodiments, three such obstructions 80 may be placed in lumen 68, for example with one near the middle of lumen 68, and one each above and below the middle of lumen 68, with approximately equal space between them. It will be understood that obstruction(s) 80 may be formed as a part of or otherwise joined to conduit 26, and may be placed above or below the midpoint of conduit 26. As noted below, it has been found that placement of a single obstruction 80 at or near the midpoint, or multiple obstructions 80 as indicated above, provides good performance.

Thus, in particular examples conduit 26 is a ½ inch PVC or CPVC pipe in some embodiments, which includes ⅛th inch cuts along the side(s) in two consistent rows in a particular embodiment. Inside conduit 26 are three obstructions 80 (in the form of 00 facet washers as a particular example), in the top, middle and lower portion. Conduit 26 aligns with collar or cap 60 centered in support 24 and sits within collar or cap 60. In use, apparatus 20 is prepared by removing top 34 to obtain access to internal volume 36 and spindles 56, 58. Hubs 66 (if provided) may also be removed from spindles 56, 58 if necessary, and drain 38 may be opened (as by removing cap 40). Hose 50 is connected to connection 49 as indicated previously to provide a supply of rinsing medium. For example, hose 50 may be a conduit to a consumer tap or spigot, such as an outdoor faucet or water heater in a family home, so that household tap water is conveyed to apparatus 20.

Paint roller cover(s) 90 that have been used for painting are each placed over respective spindles 56, 58 and hubs 64, so that each cover is securely held yet rotatable around spindles 56, 58. The illustrated embodiment can be used to clean or rinse two covers 90 at once, as shown, or can be used for a single cover 90 if one spindle is left unused. If second hubs 66 are provided, respective cover(s) 90 and/or hub(s) 66 are placed over respective spindles 56, 58 so that hub(s) 66 are within their respective cover(s) 90. Each cover 90 is secured to hubs 64 and/or 66 (at its ends in the illustrated embodiment) so as to be secured to and rotatable around spindles 56, 58.

With covers 90 so placed, top 34 is replaced to close and seal interior volume 36. Conduit 26 fits securely in collar 60, so that conduit 26 is held against significant motion with respect to container 22. Flow through conduit 26 is then begun, as by opening a water faucet to which hose 50 is connected, and/or opening valve 51. Flow of water (e.g. at home or consumer pressure) moves into conduit 26. With lumen 68 of conduit 26 closed at its lower end and/or blocked by collar 60 and/or base 54, and partially obstructed intermediately by obstruction 80, water is forced through holes 70, 72 and slots 76, 78. Water shoots out in generally diametrically opposed directions from holes 70, 72 and slots 74, 76, spreading generally along a plane (e.g. a plane into the page represented by line P in FIG. 8), which is a substantially vertical plane in this example. The plane of water strikes each cover 90 slightly off-center, causing each cover 90 to rotate around its respective spindle 56, 58.

As covers 90 rotate due to the fluid momentum, their entire surface is rinsed. Some of the rinse-water cascades downward from covers 90 to drip to bottom 32 of container 22, and the rotating motion of covers 90 spins rinse-water off toward wall 30 of container 22 as well. Continued flow of water maintains the spinning of the covers around spindles 56, 58 and continues rinsing them. Water exuded from the covers collects in bottom 32 of container 22 and drains out of drain 38.

When the covers are satisfactorily rinsed, water flow is discontinued (e.g. at the source or by closing valve 51). If top 34 is provided with viewing port(s) 52, the user can observe the rinsing of covers 90 and can turn off the flow when rinsing is believed to be complete. Top 34 is opened or removed from container 22, and hubs 66 (if present) are also removed if necessary. Assuming they are satisfactorily cleaned, covers 90 are taken off of spindles 56, 58 by disconnection from hubs 64 and withdrawal along spindles 62. Covers 90 may be dried or otherwise treated for storage or later reuse. If further rinsing is believed to be needed, top 34 may be re-engaged prior to removing covers 90 from device 20, and water flow can be re-established.

The water used to rinse covers 90 drains out of volume 36 within container 22 through drain 38. If top 34 has been removed, any water remaining in interior volume 36 can be emptied through drain 38, through the uncovered main opening of container 22, or otherwise. Cap 42 is replaced on drain 38, and hubs 66 may be replaced on spindles 56, 58 or otherwise placed for storage in interior volume 36. Top 34 is reattached, and if desired hose 50 or other source of water is disconnected from connection 49 and/or fitting 48. If hose 50 is of appropriate size, it can be stored within container 22. Apparatus 20 is then easily transported or stored for later use.

To summarize exemplary use of apparatus 20, the user may initially roll out or otherwise remove as much excess paint in the roller cover(s) as possible, and remove the roller cover from the roller. Roller cover(s) 90 are placed over spindles 56, 58 as noted above, or end caps as noted above may be placed in both ends of cover(s) 90, then placed on spindles 56, 58 so that end caps can spin around the spindles above or atop support 24 and/or any spacer on support 24. Hose 50 is connected firmly to fitting 49, and the combination of top 34, conduit 26, valve 51, and fitting 49 with hose 50 is assembled with container 22 so that conduit 26 fits into collar or cap 60 on bottom 32 of container 22. With cap 40 off of drain 38, and valve 51 closed, the water or other fluid supply is turned on. With the supply on, valve 51 is opened to allow flow into conduit 26 to spray outward from conduit 26. The user can then point the water spray towards one half of cover(s) 90 (e.g. to the left of the spindles) or to the other half of cover(s) 90 (e.g. to the right of the spindles) to transfer the fluid's momentum to the roller cover(s), spinning them around spindles 56, 58. The user can watch the roller covers spin and be cleaned through opening(s) 52 in top 34. If desired, conduit 26 can be moved so that spray is directed toward another part of the roller cover(s), for example striking the covers to spin them in the opposite direction. Also, the user can stop the follow (as by closing valve 51), remove top 34, turn each roller cover upside down on spindles 56, 58, replace top 34, and resume the flow, so as to clean the roller cover(s) in a different way or spin them in the other direction. Once the water or other fluid runs clear or substantially so from drain 38, the cover(s) can be removed from apparatus 20 and any leftover fluid can be shaken out or otherwise dried or allowed to dry. In testing, roller cover(s) have been substantially cleaned in about 4-5 minutes of use of an embodiment of apparatus 20, with roller cover(s0 being ready to be used again after shaking out or drying. Use of water to rinse paint roller covers has been described above because of the common availability and usefulness of water-based paints, and in light of the general availability of pressurized water from consumer or similar sources. Other solvents or rinsing agents under pressure could be used with apparatus 20, particularly if other types of paints are used.

Apparatus 20 may be made of any of a number of sturdy materials. However, for ease of transportation and use, it is believed that hard but lightweight plastics are generally indicated for most or all of the parts discussed above. Thicker or sturdier plastics or materials such as metals may be indicated for heavier-wearing parts, such as bearings or other mechanisms that experience significant rubbing or other contact with other parts, or for supporting parts. Such plastics as are used for commercially-available paint buckets provide both sturdiness and the ability to easily lift and transport apparatus 20. In fact, in particular embodiments buckets similar or identical to five- or six-gallon bulk paint buckets that are commercially available may be used for or as part of container 22 and top 34.

The particular embodiments discussed above provide structure and methods for cleaning two paint roller covers at one time. As previously noted, such structure can be used for only one roller cover, with one spindle 56 or 58 remaining empty. It will be understood that other embodiments may include only one spindle, perhaps in a smaller container, for cleaning one roller cover at a time. In such a one-cover apparatus, holes and/or slots as discussed above may only be needed in one side of conduit 26. Similarly, it will be understood that additional spindles could be provided in accordance with the above discussion, e.g. four spindles each spaced 90 degrees, and additional sets of holes and/or slots provided in conduit 26 to allow cleaning of more than two covers at a time.

Figure 9:
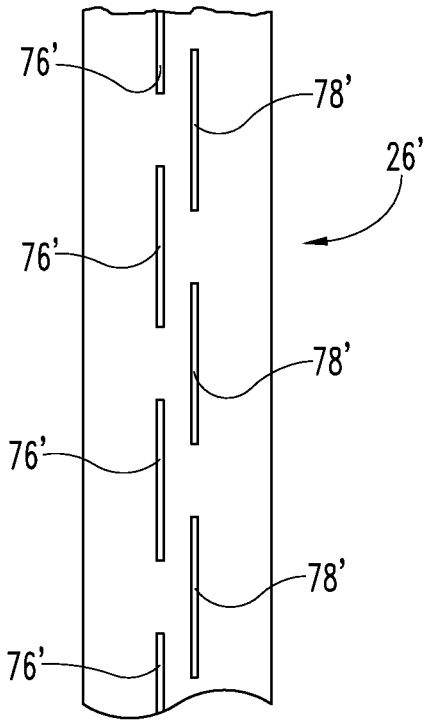
FIG. 9 is an elevational view of a portion of an embodiment of structure useful in the embodiment of FIG. 1.

Other embodiments of apparatus 20 or parts of it are contemplated. For example, FIG. 9 shows an alternative conduit 26'. All features of conduit 26' and its relationship to other parts of apparatus 20 are the same as described above with respect to conduit 26, with the exception of holes 70, 72 and slots 76, 78 of conduit 26. The embodiment of conduit 26' shows two lines of slots 76' and 78' in one side of conduit 26'. Slots 76' and 78' are configured substantially identically to slots 76 and 78. Slots 76' are in a first line and slots 78' are in a second line, each of which are parallel to the longitudinal axis of conduit 26'. Slots 76' and 78' are laterally offset from each other and longitudinally overlapping, so that the space between adjacent slots 76' faces a slot 78', and vice versa. A similar selection of slots 76' and 78', or a configuration of holes and slots as suggested above, may be placed in the diametrically opposite portion of conduit 26', as is described above with respect to conduit 26.

Figure 10:
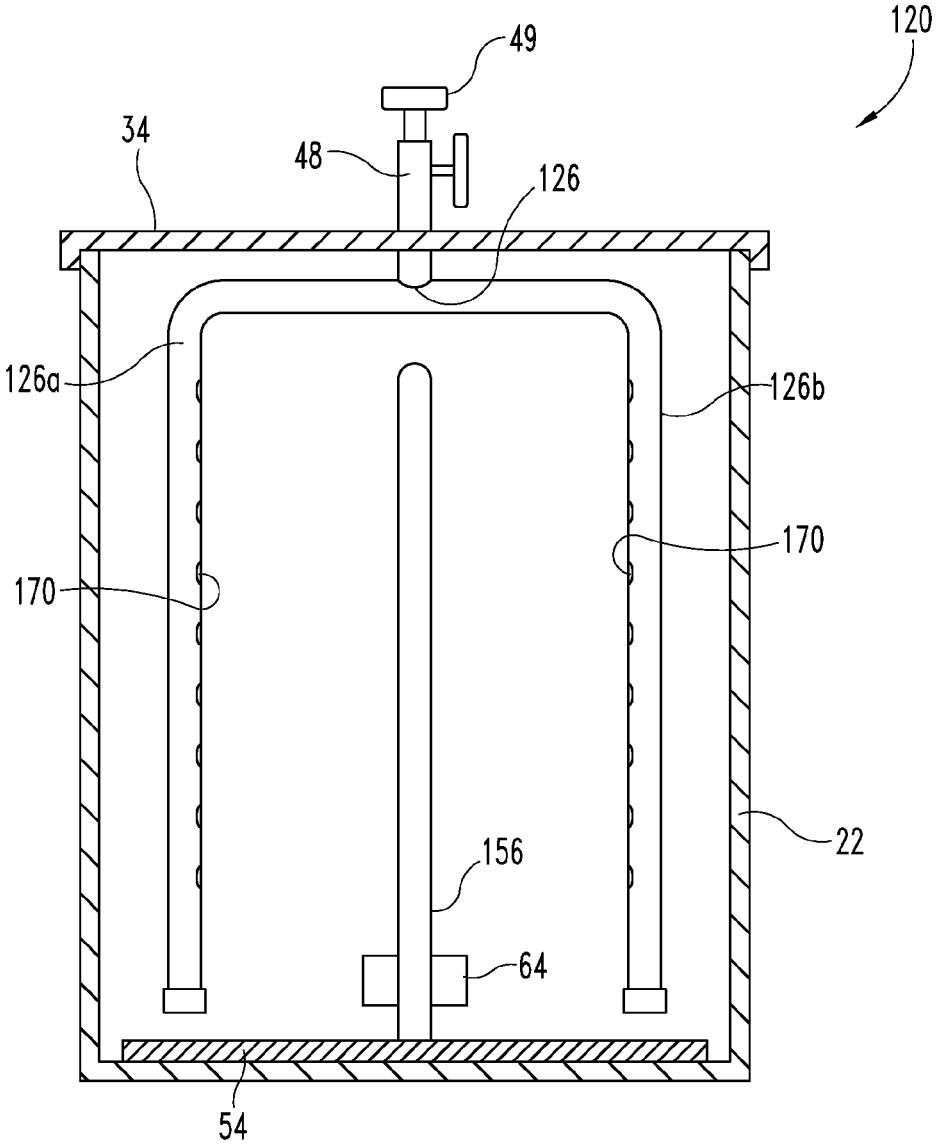
FIG. 10 is a part cross-sectional view of another embodiment of apparatus according to the present disclosure.

As another example, an apparatus 120 (FIG. 10) may include one central spindle 156 (with hub 164) and a conduit 126 that divides into two lateral branches 126*a* and 126*b*. Each branch 126*a*, 126*b* includes a series of holes and/or slots (e.g. holes 170) as discussed above, to spray rinsing medium off-center with respect to spindle 156. In such an embodiment, such holes and/or slots would be arranged so that each would point to the same direction (left or right, viewed from each branch's viewpoint) of spindle 156 so that each spray would propel a cover on spindle 156 in the same rotational direction (clockwise or counterclockwise). Other aspects of apparatus 120 are similar or identical to those described above with respect to apparatus 20.

Embodiments of apparatus 20 as described above have been built and tested. It has been found that such embodiments adequately clean paint roller covers with between 2 and 5 minutes of spray directed at the covers. Covers cleaned using such embodiments, after drying, have retained much of their original softness, were not misshaped as can happen with manual cleaning, and were easily able to be reused multiple times.

While the embodiments have been illustrated and described in detail in the drawings and foregoing description, the same is to be considered as illustrative and not restrictive in character, it being understood that only particular embodiments have been shown and described and that all changes and modifications that come within the spirit of the disclosure are desired to be protected. It will be understood that features or attributes noted with respect to a specific embodiment may be used or incorporated into other embodiments of the structures and methods disclosed.

What is claimed is:

1. An apparatus, comprising:

a container having a top that encloses an internal volume, said top being removable to allow access to said internal volume;

a first spindle and a second spindle fixed to said container and within said internal volume;

a conduit connectable to a source of fluid, said conduit extending into said internal volume between said first and second spindles, said conduit defining an internal lumen, said conduit having a first set of openings that communicate with said lumen and are directed generally toward but off-center with respect to said first spindle, and a second set of openings that communicate with said lumen and are directed generally toward but off-center with respect to said second spindle wherein said conduit has an inner surface that surrounds said lumen and an outside surface, and wherein one or more of said first openings are longitudinally-oriented slots with linearly sloping sides, so that the length of a respective said slot at said outside surface is greater than its length at said inside surface.

2. The apparatus of claim 1, wherein said source of fluid is a hose to supply water under pressure, and when water under pressure flows into said conduit, the water sprays out of said first set of openings substantially in a single plane and out of said second set of openings substantially in a single plane.

3. The apparatus of claim 2, wherein said first set of openings is diametrically opposed to said second set of openings, whereby the spray from said first set of openings and the spray from said second set of openings are substantially coplanar and oppositely directed.

4. The apparatus of claim 1, further comprising at least one partial obstructions lodged in said lumen of said conduit.

5. The apparatus of claim 1, wherein said container includes at least one view port adapted to allow a user to see conditions inside said container while said top encloses said volume.

6. The apparatus of claim 5, wherein said at least one view port is in said top.

7. The apparatus of claim 1, further comprising a collar fixed to said container in said internal volume, wherein said conduit seats in said collar when said top encloses said internal volume.

8. A device for cleaning paint roller covers, comprising;

a container having one or more side walls, a bottom surface, and a removable top connectable to said one or more side walls, said container defining a closed internal volume when said top is connected to said one or more side walls, and including a drain in a lower portion of said container;

a support within said container, said support including a base member fixed to said container and at least one spindle fixed to and extending from said base member through said internal volume, said spindle sized to allow a paint roller cover around it; and a conduit extending through said internal volume from said removable top, said conduit having a longitudinal lumen and a plurality of longitudinally aligned holes communicating with said lumen, and wherein said conduit further includes a plurality of longitudinally-oriented slots, each said slot being between a pair of said holes, at least part of said slots communicating with said lumen, wherein said conduit includes at least one partial obstruction in said lumen to provide a high-speed spray, whereby fluid entering said lumen of said conduit can exit through said holes and slots.

9. The device of claim 8, wherein said support includes a collar into which a portion of said conduit fits when said removable top is connected to said one or more side walls.

10. The device of claim 8, wherein said holes and slots of said conduit are oriented so that they are directed to the side of said spindle.

11. The device of claim 8, wherein said spindle is a first spindle, and further comprising a second spindle fixed to and extending from said base member through said internal volume, said second spindle sized to allow a paint roller cover around it, wherein said first spindle and said second spindle are on opposite sides of said conduit.

12. The device of claim 11, wherein said plurality of holes is a first plurality of holes and said plurality of slots is a first plurality of slots, and further comprising a second plurality of longitudinally aligned holes communicating with said lumen and a second plurality of longitudinally-oriented slots, each said slot of said second plurality of slots being between a pair of holes of said second plurality of holes, wherein said second plurality of holes and said second plurality of slots are on an opposite side of said conduit to said first plurality of holes and said first plurality of slots, and wherein said conduit is on a line connecting said first and second spindles, and said first plurality of holes and first plurality of slots are aimed off center at the first spindle at the same time that the second plurality of holes and second plurality of slots are aimed off center at the second spindle.

13. The device of claim 12, wherein a plurality of partial obstructions are in said lumen.

14. The device of claim 13, wherein said obstructions are spaced from each other in said lumen.

15. The device of claim 8, wherein said obstruction comprises a washer inserted into said lumen with an interference fit.

16. The device of claim 8, further including a connection for a hose, said connection in fluid communication with said conduit.

17. The device of claim 16, further including a valve between said connection and said conduit, said valve being outside of said internal volume when said top is connected to said one or more walls.

18. The device of claim 8, further comprising a hub connected to said spindle to support a paint roller cover.

19. The device of claim 18, wherein said hub is removable from said spindle and replaceable onto said spindle, said hub configured to fit snugly within a paint roller cover.

* * * * *